US005953575A

United States Patent [19]

Park et al.

[11] Patent Number: 5,953,575

[45] Date of Patent: Sep. 14, 1999

[54] PAPER GUIDE DEVICE FOR DUPLEX IMAGE FORMING APPARATUS

[75] Inventors: Seo-Won Park; Byeong-Hwa Ahn, both of Kyonggi-do, Rep. of Korea

[73] Assignee: SamSung Electronics Co., Ltd., Kyungki-do, Rep. of Korea

[21] Appl. No.: 09/167,580

[22] Filed: Oct. 7, 1998

[30] Foreign Application Priority Data

Oct. 7, 1997 [KR] Rep. of Korea ..... 97-27822

[51] Int. Cl.[6] ..... G03G 15/00

[52] U.S. Cl. ..... 399/401; 399/388; 399/406; 271/186; 271/902

[58] Field of Search ..... 399/388, 397, 399/401, 406; 271/264, 902, 301, 186, 65

[56] References Cited

U.S. PATENT DOCUMENTS

| | | | |
|---|---|---|---|
| 4,090,787 | 5/1978 | Hubbard et al. . | |
| 4,583,844 | 4/1986 | Honda | 399/124 |
| 4,878,087 | 10/1989 | Sakai et al. . | |
| 4,928,127 | 5/1990 | Stemmle | 399/364 |
| 5,030,991 | 7/1991 | Zaitsu et al. . | |
| 5,034,771 | 7/1991 | Makita . | |
| 5,081,490 | 1/1992 | Wakao . | |
| 5,258,818 | 11/1993 | Sundquist et al. . | |
| 5,448,348 | 9/1995 | Azeta | 271/65 X |
| 5,680,651 | 10/1997 | Tsuji et al. | 399/401 |
| 5,690,325 | 11/1997 | Morimoto | 271/65 |
| 5,781,823 | 7/1998 | Isobe et al. | 399/401 X |
| 5,857,138 | 1/1999 | Iida et al. | 399/401 X |
| 5,872,900 | 2/1999 | Tsuchitoi | 399/401 X |

FOREIGN PATENT DOCUMENTS

| | | |
|---|---|---|
| 60-102348 | 6/1985 | Japan . |
| 3-067872 | 3/1991 | Japan . |
| 3-138256 | 6/1991 | Japan . |
| 3-185465 | 8/1991 | Japan . |
| 8-151166 | 6/1996 | Japan . |

*Primary Examiner*—Matthew S. Smith
*Attorney, Agent, or Firm*—Robert E. Bushnell, Esq.

[57] ABSTRACT

A paper guide device for a duplex image forming apparatus. The paper guide device for a duplex image forming apparatus having, on a reverse paper feed path, an upper paper guide, a lower paper guide installed under the upper paper guide, and a paper cassette installed under the lower paper guide, includes a first side guide rail extended along one side of the lower paper guide and bent inwards, and a hinge guide having one side coupled to the lower paper guide by a hinge and having the opposite side curved upwards.

20 Claims, 4 Drawing Sheets

PAPER GUIDE DEVICE FOR DUPLEX IMAGE FORMING APPARATUS

CLAIM OF PRIORITY

This application makes reference to, incorporates the same herein, and claims all benefits accruing under 35 U.S.C. §119 from an application entitled Paper Guide Device for Duplex Image Forming Apparatus earlier filed in the Korean Industrial Property Office on the 7th day of October 1997, and there duly assigned Ser. No. 27822/1997, a copy of which is annexed hereto.

BACKGROUND OF THE INVENTION

1. Technical Field

The present invention relates to a duplex image forming apparatus, and more particularly, to a paper guide device which can easily eliminate a paper jam on a paper feed path for duplexing printing.

2. Related Art

A printer is a device that is able to print information onto a sheet of paper. Typically, a printer includes a set of rollers able to feed a sheet of paper along a path while the information is being printed onto the sheet of paper. Sometimes a jam occurs in a printer when a sheet of paper adheres improperly to a roller or when a sheet of paper is fed in an incorrect manner.

A simplex printing process is a printing process which records information onto one side of a sheet of paper. A duplex printing process is a printing process which records information onto both sides of a sheet of paper. A duplex printer is a printer that is able to print information onto both sides of a sheet of paper. Jams sometimes occur more frequently during duplex printing than during simplex printing. This increase in the occurrence of jams during duplex printing can often be attributed to the increased complexity involved during duplex printing.

Some duplex printers include a set of rollers able to rotate in a clockwise direction and in a counterclockwise direction. Thus, while information is printed onto a first side of a sheet of paper, a duplex printer's rollers may be rotating in a first direction to feed the sheet of paper along a first path. Then, after the information has been printed onto the first side of the sheet of paper, the duplex printer's rollers may be required to rotate in a second direction in order to feed the sheet of paper along a second path so that data can be printed onto the second side of the sheet of paper.

I have found that paper jams during any type of printing process, including a duplex printing process, can be extremely inconvenient. Efforts have been made to reduce the occurrence of paper jams.

Exemplars of recent efforts in the art include U.S. Pat. No. 5,258,818 for Photocopier with Duplex Tray Save after Jam issued to Sundquist et al., U.S. Pat. No. 5,081,490 for Method of Controlling Image Forming Apparatus When a Jam Occurs in the Original Feeder issued to Wakao, U.S. Pat. No. 5,034,771 for Copier Having Superimposed and Duplex Copying Capabilities and Capable of Discriminating False Paper Jam and Real Paper Jam issued to Makita, U.S. Pat. No. 5,030,991 for Jam Detection and Clearance System for Duplex Copiers issued to Zaitsu et al., U.S. Pat. No. 4,878,087 for Image Forming Apparatus with Jam Removal Mechanism issued to Sakai et al., and U.S. Pat. No. 4,090,787 for Automatic Copier Mode Controls issued to Hubbard et al.

While these recent efforts provide advantages, I note that they fail to adequately address how a paper guide can conveniently and efficiently eliminate a paper jam for duplex printing.

SUMMARY OF THE INVENTION

It is therefore an object of the present invention to provide a paper guide device which can easily eliminate a paper jam on a reverse paper feed path by extracting only a paper cassette in a duplex image forming apparatus.

To achieve this and other objects of the present invention, a paper guide device for a duplex image forming apparatus having, on a reverse paper feed path, an upper paper guide, a lower paper guide installed under the upper paper guide, and a paper cassette installed under the lower paper guide, includes a first side guide rail extended along one side of the lower paper guide and bent inwards, and a hinge guide having one side coupled to the lower paper guide by a hinge and having the opposite side curved upwards.

To achieve these and other objects in accordance with the principles of the present invention, as embodied and broadly described, the present invention provides a guide apparatus of an image forming device, comprising: an upper guide guiding a recordable medium along a path of conveyance in an image forming device; a primary guide being installed under said upper guide, said primary guide guiding the recordable medium along said path of conveyance, said primary guide having a top surface adjacent to said upper guide, a bottom surface, an upstream section, and a downstream section, the recordable medium being guided along said path of conveyance from said upstream section of said primary guide to said downstream section of said primary guide; a cassette being removably installed in said image forming device under said primary guide, said cassette storing the recordable medium; a hinge being coupled to said primary guide at said downstream section of said primary guide; a secondary guide being rotatably coupled to said hinge at an upstream section of said secondary guide, said secondary guide receiving the recordable medium from said primary guide and guiding the recordable medium along said path of conveyance, said secondary guide having a top surface, a bottom surface disposed above said cassette, and a downstream section, the recordable medium being guided and transported along said path of conveyance from said upstream section of said secondary guide to said downstream section of said secondary guide, said secondary guide being in a closed position when said top surface and said downstream section of said secondary guide are in a first position adjacent to said upper guide, and said secondary guide being in an open position when said secondary guide is rotated at said hinge to a second position down and away from said upper guide such that said downstream section of said secondary guide is not adjacent to said upper guide; and a first side rail being formed along a first edge of said primary guide to curve away from said top surface of said primary guide and toward a second edge of said primary guide, said first side rail restricting a curling of the recordable medium, wherein the recordable medium being guided and transported along said path of conveyance from said upstream section of said primary guide to said downstream section of said primary guide is transported in a direction parallel to said first and second edges of said primary guide.

To achieve these and other objects in accordance with the principles of the present invention, as embodied and broadly described, the present invention provides a guide apparatus of an image forming device, comprising: an upper guide guiding a recordable medium along a path of conveyance in an image forming device; a primary guide being installed under said upper guide, said primary guide guiding the recordable medium along said path of conveyance, said primary guide having a top surface adjacent to said upper guide, a bottom surface, an upstream section, and a downstream section, the recordable medium being guided along said path of conveyance from said upstream section of said primary guide to said downstream section of said primary guide; a cassette being removably installed in said image forming device under said primary guide, said cassette storing the recordable medium; a hinge being coupled to said primary guide at said downstream section of said primary guide; a secondary guide being rotatably coupled to said hinge at an upstream is section of said secondary guide, said secondary guide receiving the recordable medium from said primary guide and guiding the recordable medium along said path of conveyance, said secondary guide having a top surface, a bottom surface disposed above said cassette, and a downstream section, the recordable medium being guided and transported along said path of conveyance from said upstream section of said secondary guide to said downstream section of said secondary guide, said secondary guide being in a closed position when said top surface and said downstream section of said secondary guide are in a first position adjacent to said upper guide, and said secondary guide being in an open position when said secondary guide is rotated at said hinge to a second position down and away from said upper guide such that said downstream section of said secondary guide is not adjacent to said upper guide, said secondary guide being in said closed position when said cassette is inserted into said image forming device, said secondary guide being in said open position when said cassette is removed from said image forming device; an elastic unit secured to said bottom surface of said primary guide and said bottom surface of said secondary guide, said elastic unit facilitating a rotation of said secondary guide among said open position and said closed position; and a first side rail being formed along a first edge of said primary guide to curve away from said top surface of said primary guide and toward a second edge of said primary guide, said first side rail restricting a curling of the recordable medium, wherein the recordable medium being guided and transported along said path of conveyance from said upstream section of said primary guide to said downstream section of said primary guide is transported in a direction parallel to said first and second edges of said primary guide.

To achieve these and other objects in accordance with the principles of the present invention, as embodied and broadly described, the present invention provides a guide apparatus of an image forming device, comprising: an upper guide guiding a recordable medium along a path of conveyance; a primary guide being adjacent to said upper guide and guiding the recordable medium along said path of conveyance between said upper guide and said primary guide, said primary guide having a first surface receiving the recordable medium, an upstream section, and a downstream section, the recordable medium being guided along said path of conveyance from said upstream section of said primary guide to said downstream section of said primary guide; a cassette being removably installed in said image forming device, said cassette storing the recordable medium; a connector being coupled to said primary guide at said downstream section of said primary guide; a secondary guide being rotatably coupled to said connector at an upstream section of said secondary guide, said secondary guide receiving the recordable medium from said primary guide and guiding the recordable medium along said path of conveyance between said upper guide and said secondary guide, said secondary guide having a first surface receiving the recordable medium, a second surface not receiving the recordable medium, and a downstream section, the recordable medium being guided and transported along said path of conveyance from said upstream section of said secondary guide to said downstream section of said secondary guide, said secondary guide being in a closed position when said first surface and said downstream section of said secondary guide are adjacent to said upper guide, and said secondary guide being in an open position when said secondary guide is rotated at said connector to a second position down and away from said upper guide such that said downstream section of said secondary guide is not adjacent to said upper guide; and a first side rail being formed along a first edge of said primary guide to curve away from said top surface of said in primary guide and toward a second edge of said primary guide, said first side rail restricting a curling of the recordable medium, wherein the recordable medium being guided and transported along said path of conveyance from said upstream section of said primary guide to said downstream section of said primary guide is transported in a direction parallel to said first and second edges of said primary guide.

The present invention is more specifically described in the following paragraphs by reference to the drawings attached only by way of example. Other advantages and features will become apparent from the following description and from the claims.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
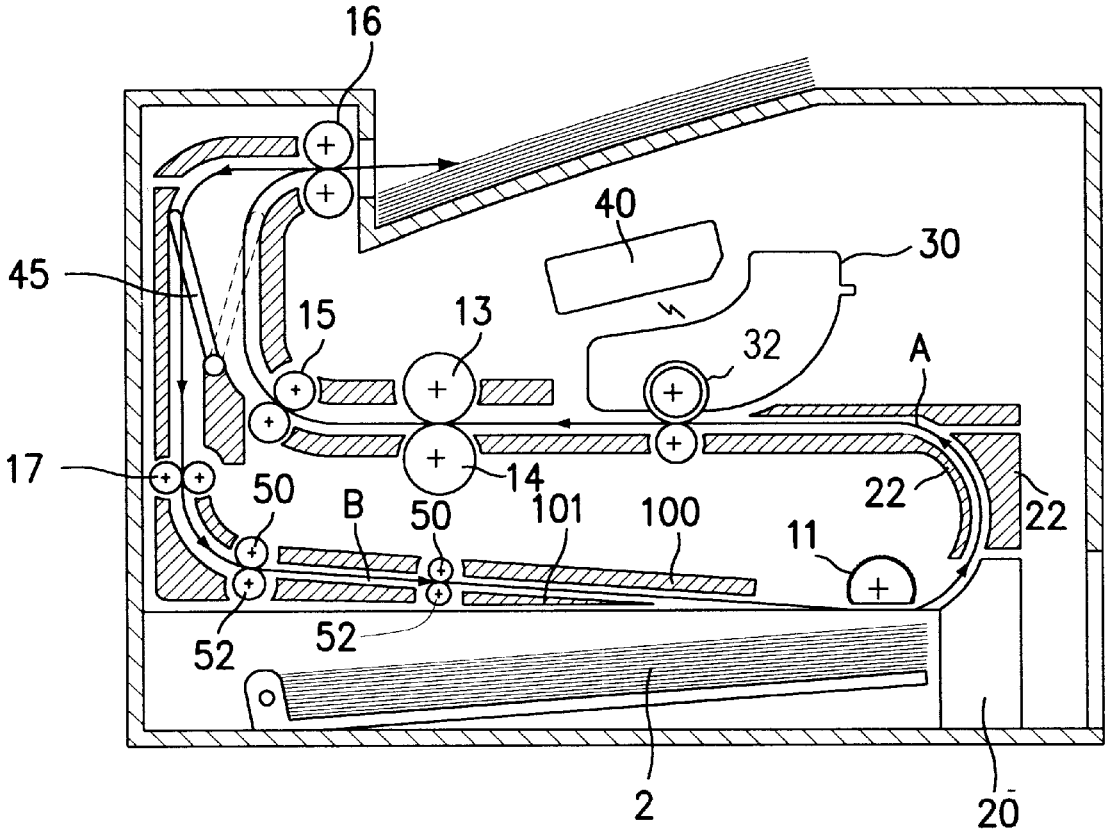
FIG. 1 is a schematic diagram showing the internal construction of a duplex image forming apparatus in which a paper guide device is installed.

Turn now to FIG. 1, which is a schematic diagram showing the internal construction of a duplex image forming apparatus in which a paper guide device is installed. A single sheet of paper 2 stored in a paper cassette 20 is picked up by the revolution of a pickup roller 11 and then fed to a developing unit 30 along a paper feed path "A". An electrostatic latent image is formed on a photoconductive drum 32 of the developing unit 30 by an exposing unit 40. The photoconductive drum 32 in which a toner is developed transfers a toner image onto the sheet 2. The toner image is fixed onto the sheet 2 when the sheet 2 passes between a fixing roller 13 and a heating roller 14. The sheet 2 which has passed between the fixing roller 13 and the heating roller 14 passes between delivery rollers 15. The turning force of the delivery rollers 15 causes a leading end of the sheet 2 to revolve a reverse guide 45. In simplex printing, the sheet 2 is ejected to the exterior through exit rollers 16 when exit rollers 16 are revolving in a first direction.

For duplex printing, however, the above-described simplex printing process is repeated once more. During duplex printing, when the sheet 2 passes through the reverse guide 45, a paper sensor (not shown) senses the sheet 2. The exit rollers 16 revolve reversely by an auxiliary motor (not shown). In other words, the exit rollers 16 revolve in a second direction opposite to the aforementioned first direction. Then the sheet 2 is not ejected to the exterior and the sheet 2 is fed inside out between reverse convey rollers 17 along a reverse paper feed path "B". The sheet 2 passes between a driving roller 50 and a reverse convey roller 52 and further between a upper paper guide 100 and a lower paper guide 101, thereby reaching the pickup roller 11. The reverse convey rollers 17 and 52 and the driving roller 50 revolve by a driving motor (not shown). The sheet 2 fed to the pickup roller 11 repeatedly undergoes the image forming process of simplex printing and then is ejected to the exterior. In other words, to complete the duplex printing process, the sheet 2 is fed to the pickup roller 11 and undergoes the image forming process of simplex printing for a second and last time.

In some cases, a sheet 2 moving along the reverse paper feed path "B" is jammed between the upper and lower paper guides 100 and 101, or between the driving roller 50 and the reverse convey roller 52. To eliminate the jammed sheet, the paper cassette 20 installed under the lower paper guide 101 should be pulled from a main body of the image forming apparatus, and the main body should be turned over to separate the upper and lower paper guides 100 and 101 therefrom.

Figure 2:
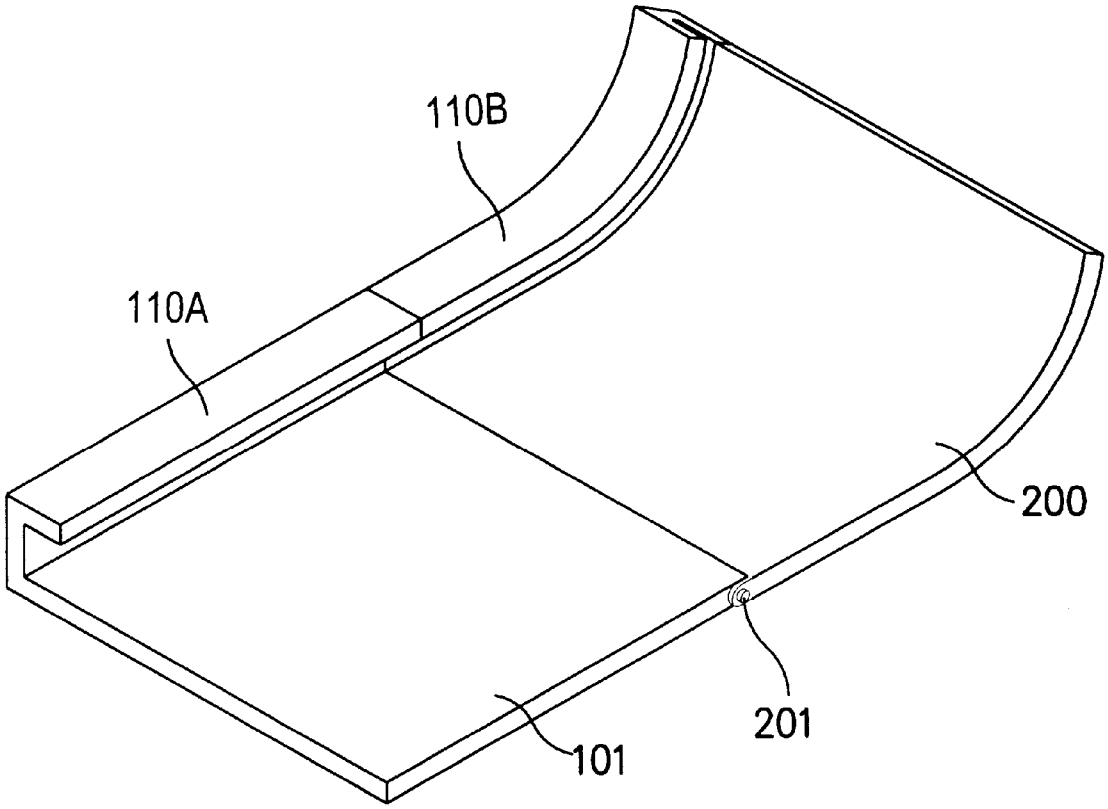
FIG. 2 is a first preferred embodiment of a paper guide device, in accordance with the principles of the present invention.

Turn now to FIG. 2, which is a first preferred embodiment of a paper guide device, in accordance with the principles of the present invention. In FIG. 2, the paper guide device includes a lower paper guide 101 with a first side guide rail 110A which is extended along its one side and bent inwards, and a hinge guide 200 having one side coupled to the lower paper guide 101 by a hinge 201 and having the opposite side curved upwards. The hinge guide 200 also has a second side guide rail 110B extended along its one side and bent inwards.

Figure 3:
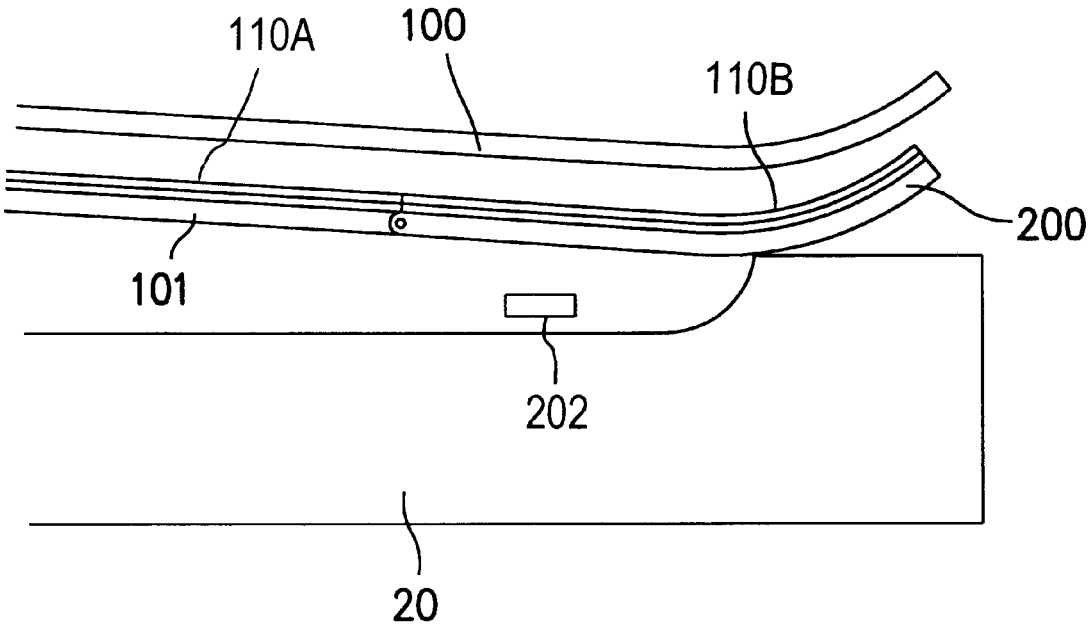
FIG. 3 is a side view of the paper guide device of FIG. 2 in case a paper cassette is inserted, in accordance with the principles of the present invention.

Turn now to FIG. 3, which is a side view of the paper guide device of FIG. 2 in case a paper cassette is inserted, in accordance with the principles of the present invention. In addition, turn to FIG. 4, which is a side view of the paper guide device of FIG. 2 in case a paper cassette is extracted, in accordance with the principles of the present invention.

Figure 4:
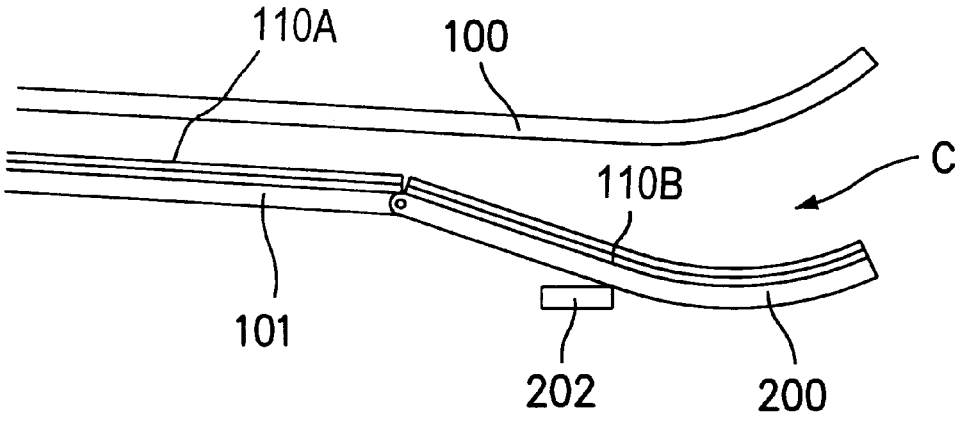
FIG. 4 is a side view of the paper guide device of FIG. 2 in case a paper cassette is extracted, in accordance with the principles of the present invention.

In accordance with the first preferred embodiment of the present invention, the paper guide device shown in FIGS. 2, 3, and 4 is installed under the upper paper guide 100, and a stopper 202 extended from the inner side of the main body of the duplex image forming apparatus is installed under the hinge guide 200 at a position separated from the hinge guide 200 by a prescribed distance, as shown in FIG. 3.

When the paper cassette 20 is inserted, its upper portion pushes up the curved part of the hinge guide 200. Therefore, the hinge guide 200 is horizontally maintained and a sheet is fed between the upper and lower paper guides 100 and 101.

If a paper jam occurs between the upper and lower paper guides 100 and 101, the jammed sheet can be eliminated by extracting the paper cassette 20. That is, if the paper cassette 20 is extracted, the hinge guide 200 revolves about the hinge 201 by its weight and the bottom portion of the hinge guide 200 gets stuck on the stopper 202, as indicated in FIG. 4. Then the user can take out the jammed sheet by inserting his or her hand into a space "C" opened between the hinge guide 200 and the upper paper guide 100, as shown in FIG. 4.

Figure 5:
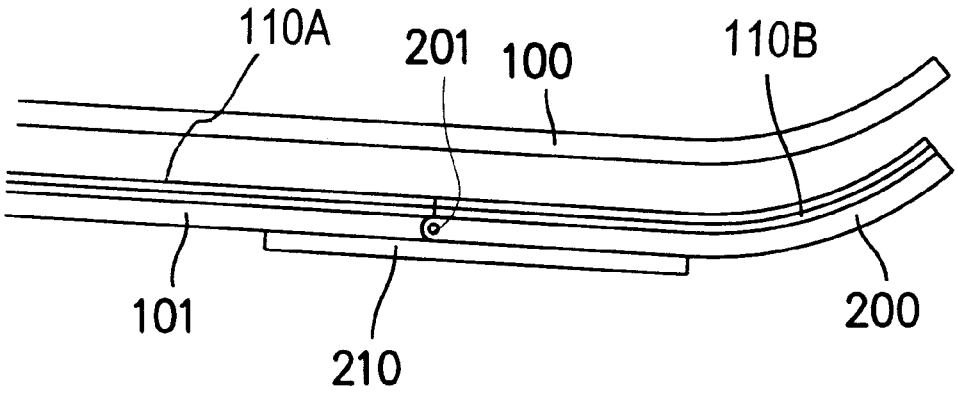
FIG. 5 is a second preferred embodiment of a paper guide device in which a plate spring is fixed, in accordance with the principles of the present invention.

Turn now to FIG. 5, which is a second preferred embodiment of a paper guide device in which a plate spring is fixed, in accordance with the principles of the present invention. In addition, turn to FIG. 6, which is a side view of the paper guide device of FIG. 5 when a hinge guide is pulled downward, in accordance with the principles of the present invention.

As shown in FIG. 5, the paper guide device according to a second preferred embodiment of the present invention includes the lower paper guide 101 with the first side guide rail 110A which is extended along its one side and bent inwards, the hinge guide 200 having one side coupled to the lower paper guide 101 by the hinge 201 and having the opposite side curved upwards, and a plate spring 210 fixed to the bottom of the lower guide 101 and the bottom of the hinge guide 200. The hinge guide 200 also has the second side guide rail 110B extended along its one side and bent inwards.

If the paper cassette 20 is inserted, its upper portion pushes up the curved part of the hinge guide 200. Then the hinge guide 200 is horizontally maintained and a sheet is fed between the upper and lower paper guides 100 and 101.

Figure 6:
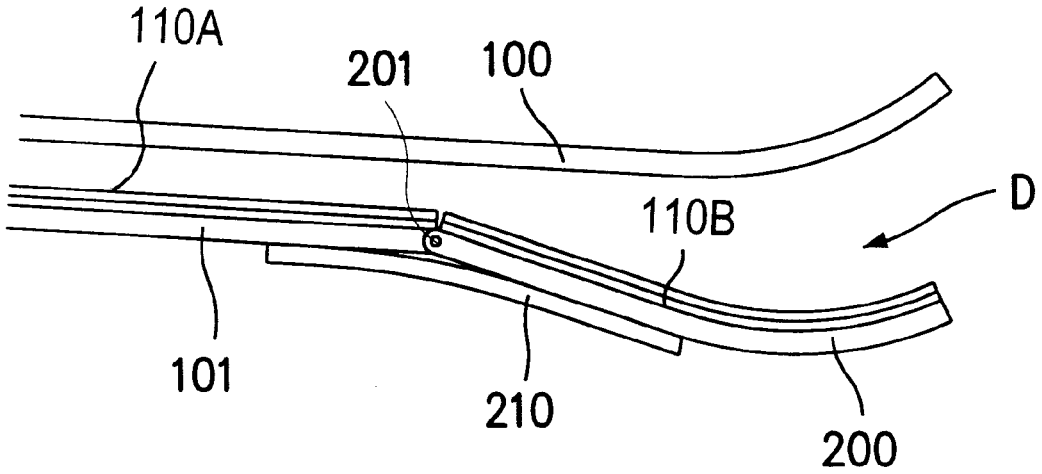
FIG. 6 is a side view of the paper guide device of FIG. 5 when a hinge guide is pulled downward, in accordance with the principles of the present invention.

If a sheet is jammed between the upper and lower paper guides 100 and 101, the jammed sheet can be eliminated by extracting the paper cassette 20. Namely, if the user extracts the paper cassette 20 and pulls the curved part of the hinge guide 200 downwards, the hinge guide 200 revolves about the hinge 201, as shown in FIG. 6. The hinge guide 200 can be opened at a specified angle by the plate spring 210. The user may eliminate the jammed sheet by inserting his or her hand into a space "D" opened between the hinge guide 200 and the upper paper guide 100. If the user takes his or her hand off the hinge guide 200, the hinge guide 200 turns to the original position by the restoring force of the plate spring 210.

As noted in the foregoing paragraphs, the inventive paper guide device can easily eliminate a paper jam on a reverse paper feed path by extracting only the paper cassette. While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A guide apparatus of an image forming device, comprising:

an upper guide guiding a recordable medium along a path of conveyance in an image forming device;

a primary guide being installed under said upper guide, said primary guide guiding the recordable medium along said path of conveyance, said primary guide having a top surface adjacent to said upper guide, a bottom surface, an upstream section, and a downstream section, the recordable medium being guided along said path of conveyance from said upstream section of said primary guide to said downstream section of said primary guide;

a cassette being removably installed in said image forming device under said primary guide, said cassette storing the recordable medium;

a hinge being coupled to said primary guide at said downstream section of said primary guide;

a secondary guide being rotatably coupled to said hinge at an upstream section of said secondary guide, said secondary guide receiving the recordable medium from said primary guide and guiding the recordable medium along said path of conveyance, said secondary guide having a top surface, a bottom surface disposed above said cassette, and a downstream section, the recordable medium being guided and transported along said path of conveyance from said upstream section of said secondary guide to said downstream section of said secondary guide, said secondary guide being in a closed position when said top surface and said downstream section of said secondary guide are in a first position adjacent to said upper guide, and said secondary guide being in an open position when said secondary guide is rotated at said hinge to a second position down and away from said upper guide such that said downstream section of said secondary guide is not adjacent to said upper guide; and a first side rail being formed along a first edge of said primary guide to curve away from said top surface of said primary guide and toward a second edge of said primary guide, said first side rail restricting a curling of the recordable medium, wherein the recordable medium being guided and transported along said path of conveyance from said upstream section of said primary guide to said downstream section of said primary guide is transported in a direction parallel to said first and second edges of said primary guide.

2. The apparatus of claim 1, further comprising a stopping unit secured to said image forming device at a location below said bottom surface of said secondary guide, said stopping unit engaging said bottom surface of said secondary guide when said secondary guide is in said open position.

3. The apparatus of claim 1, further comprising a second side rail being formed along a first edge of said secondary guide to curve away from said top surface of said secondary guide and toward a second edge of said secondary guide, said second side rail restricting a curling of the recordable medium, wherein the recordable medium being guided and transported along said path of conveyance from said upstream section of said secondary guide to said downstream section of said secondary guide is transported in a direction parallel to said first and second edges of said secondary guide.

4. The apparatus of claim 1, wherein said downstream section of said secondary guide is formed to curve up and away from said cassette when said secondary guide is in said closed position.

5. The apparatus of claim 1, wherein the recordable medium is transported along said path of conveyance after said image forming device has formed a first image on a first side of the recordable medium.

6. The apparatus of claim 5, wherein the recordable medium is transported along said path of conveyance before said image forming device has formed a second image on a second side of the recordable medium.

7. The apparatus of claim 1, wherein said image forming device corresponds to a duplex printer and said path of conveyance corresponds to a reverse path of conveyance.

8. The apparatus of claim 1, wherein the recordable medium is transported along said path of conveyance from said primary guide to said secondary guide when the recordable medium is disposed between said upper guide and said top surface of said primary guide.

9. A guide apparatus of an image forming device, comprising:

an upper guide guiding a recordable medium along a path of conveyance in an image forming device;

a primary guide being installed under said upper guide, said primary guide guiding the recordable medium along said path of conveyance, said primary guide having a top surface adjacent to said upper guide, a bottom surface, an upstream section, and a downstream section, the recordable medium being guided along said path of conveyance from said upstream section of said primary guide to said downstream section of said primary guide;

a cassette being removably installed in said image forming device under said primary guide, said cassette storing the recordable medium;

a hinge being coupled to said primary guide at said downstream section of said primary guide;

a secondary guide being rotatably coupled to said hinge at an upstream section of said secondary guide, said secondary guide receiving the recordable medium from said primary guide and guiding the recordable medium along said path of conveyance, said secondary guide having a top surface, a bottom surface disposed above said cassette, and a downstream section, the recordable medium being guided and transported along said path of conveyance from said upstream section of said secondary guide to said downstream section of said secondary guide, said secondary guide being in a closed position when said top surface and said downstream section of said secondary guide are in a first position adjacent to said upper guide, and said secondary guide being in an open position when said secondary guide is rotated at said hinge to a second position down and away from said upper guide such that said downstream section of said secondary guide is not adjacent to said upper guide, said secondary guide being in said closed position when said cassette is inserted into said image forming device, said secondary guide being in said open position when said cassette is removed from said image forming device;

an elastic unit secured to said bottom surface of said primary guide and said bottom surface of said secondary guide, said elastic unit facilitating a rotation of said secondary guide among said open position and said closed position; and a first side rail being formed along a first edge of said primary guide to curve away from said top surface of said primary guide and toward a second edge of said primary guide, said first side rail restricting a curling of the recordable medium, wherein the recordable medium being guided and transported along said path of conveyance from said upstream section of said primary guide to said downstream section of said primary guide is transported in a direction parallel to said first and second edges of said primary guide.

10. The apparatus of claim 9, wherein the recordable medium is transported along said path of conveyance from said primary guide to said secondary guide when the recordable medium is disposed between said upper guide and said top surface of said primary guide.

11. The apparatus of claim 9, further comprising a second side rail being formed along a first edge of said secondary guide to curve away from said top surface of said secondary guide and toward a second edge of said secondary guide, said second side rail restricting a curling of the recordable medium, wherein the recordable medium being guided and transported along said path of conveyance from said upstream section of said secondary guide to said downstream section of said secondary guide is transported in a direction parallel to said first and second edges of said secondary guide.

12. The apparatus of claim 9, further comprising a stopping unit secured to said image forming device at a location below said bottom surface of said secondary guide, said stopping unit engaging said bottom surface of said secondary guide when said secondary guide is in said open position.

13. The apparatus of claim 9, wherein said downstream section of said secondary guide is formed to curve up and away from said cassette when said secondary guide is in said closed position.

14. The apparatus of claim 9, wherein the recordable medium is transported along said path of conveyance after said image forming device has formed a first image on a first side of the recordable medium.

15. The apparatus of claim 14, wherein the recordable medium is transported along said path of conveyance before said image forming device has formed a second image on a second side of the recordable medium.

16. The apparatus of claim 9, wherein said image forming device corresponds to a duplex printer and said path of conveyance corresponds to a reverse path of conveyance.

17. A guide apparatus of an image forming device, comprising:

an upper guide guiding a recordable medium along a path of conveyance;

a primary guide being adjacent to said upper guide and guiding the recordable medium along said path of conveyance between said upper guide and said primary guide, said primary guide having a first surface receiving the recordable medium, an upstream section, and a downstream section, the recordable medium being guided along said path of conveyance from said upstream section of said primary guide to said downstream section of said primary guide;

a cassette being removably installed in said image forming device, said cassette storing the recordable medium;

a connector being coupled to said primary guide at said downstream section of said primary guide;

a secondary guide being rotatably coupled to said connector at an upstream section of said secondary guide, said secondary guide receiving the recordable medium from said primary guide and guiding the recordable medium along said path of conveyance between said upper guide and said secondary guide, said secondary guide having a first surface receiving the recordable medium, a second surface not receiving the recordable medium, and a downstream section, the recordable medium being guided and transported along said path of conveyance from said upstream section of said secondary guide to said downstream section of said secondary guide, said secondary guide being in a closed position when said first surface and said downstream section of said secondary guide are adjacent to said upper guide, and said secondary guide being in an open position when said secondary guide is rotated at said connector to a second position down and away from said upper guide such that said downstream section of said secondary guide is not adjacent to said upper guide; and a first side rail being formed along a first edge of said primary guide to curve away from said top surface of said primary guide and toward a second edge of said primary guide, said first side rail restricting a curling of the recordable medium, wherein the recordable medium being guided and transported along said path of conveyance from said upstream section of said primary guide to said downstream section of said primary guide is transported in a direction parallel to said first and second edges of said primary guide.

18. The apparatus of claim 17, wherein said connector corresponds to one unit among a hinge, an elastic device, a plate spring, flexible material, a clip, and a pivot.

19. The apparatus of claim 17, further comprising a second side rail being formed along a first edge of said secondary guide to curve away from said top surface of said secondary guide and toward a second edge of said secondary guide, said second side rail restricting a curling of the recordable medium, wherein the recordable medium being guided and transported along said path of conveyance from said upstream section of said secondary guide to said downstream section of said secondary guide is transported in a direction parallel to said first and second edges of said secondary guide.

20. The apparatus of claim 17, wherein said cassette is positioned adjacent to said second surface of said secondary guide when said secondary guide is in said closed position, and said downstream section of said secondary guide is formed to curve up and away from said cassette when said secondary guide is in said closed position.

* * * * *